US010569490B2

(12) United States Patent
Lechner

(10) Patent No.: US 10,569,490 B2
(45) Date of Patent: Feb. 25, 2020

(54) COMPRESSOR ARRANGEMENT FOR AUTOMATIC COMPRESSING OF GROUND COFFEE

(71) Applicant: PROBAT-WERKE VON GIMBORN MASCHINENFABRIK GMBH, Emmerich (DE)

(72) Inventor: Tilo Lechner, Hamburg (DE)

(73) Assignee: PROBAT-WERKE VON GIMBORN MASCHINENFABRIK GMBH, Emmerich (DE)

( * ) Notice: Subject to any disclaimer, the term of this patent is extended or adjusted under 35 U.S.C. 154(b) by 566 days.

(21) Appl. No.: 15/308,609

(22) PCT Filed: Mar. 11, 2015

(86) PCT No.: PCT/EP2015/055031
§ 371 (c)(1),
(2) Date: Nov. 3, 2016

(87) PCT Pub. No.: WO2015/169483
PCT Pub. Date: Nov. 12, 2015

(65) Prior Publication Data

US 2017/0182725 A1 Jun. 29, 2017

(30) Foreign Application Priority Data

May 7, 2014 (DE) ..... 10 2014 106 407

(51) Int. Cl.

| | |
|---|---|
| ***B30B 15/14*** | (2006.01) |
| ***B30B 9/30*** | (2006.01) |
| ***B30B 11/00*** | (2006.01) |
| ***B01F 5/16*** | (2006.01) |

(Continued)

(52) U.S. Cl.
CPC ..... *B30B 15/14* (2013.01); *B01F 5/16* (2013.01); *B30B 9/3096* (2013.01); *B30B 11/00* (2013.01);

(Continued)

(58) Field of Classification Search
CPC ..... B30B 11/00; B30B 11/005; B30B 11/201; B30B 11/255; B30B 9/3025; B30B 9/18;

(Continued)

(56) References Cited

U.S. PATENT DOCUMENTS 1,752,054 A * 3/1930 Anderson ..... B30B 9/18 100/148
1,835,789 A * 12/1931 Lang ..... B30B 9/12 100/117

(Continued)

FOREIGN PATENT DOCUMENTS

CN 202953191 U 5/2013
DE 580 974 C 7/1933

(Continued)

*Primary Examiner* — Gregory D Swiatocha
(74) *Attorney, Agent, or Firm* — Norman B. Thot

(57) ABSTRACT

A compressor arrangement for automatically compressing ground coffee includes a housing having an inlet opening and an outlet opening with a retention flap which adjusts a bulk density of the ground coffee, conveying and compressing elements arranged in the housing which are driven by a first drive device, and an adjustment device which pre-adjusts the bulk density of the ground coffee. The adjustment device includes a second drive device, a retention flap shaft, a retention flap arranged on the retention flap shaft, a transmission which is operatively connected to each of the second drive device and the retention flap shaft, and an automatic dynamic pressure adjustment apparatus which enlarges or reduce a preset of the opening angle dependent on a higher dynamic pressure or a lower dynamic pressure being exerted on the retention flap. The transmission includes a transmission device which limits an opening angle of the retention flap.

9 Claims, 3 Drawing Sheets

(51) Int. Cl.
*B30B 15/30* (2006.01)
*B30B 15/32* (2006.01)

(52) U.S. Cl.
CPC ..... *B30B 11/005* (2013.01); *B30B 15/308* (2013.01); *B30B 15/32* (2013.01); *B01F 2215/0014* (2013.01)

(58) Field of Classification Search
CPC ..... B30B 9/3096; B30B 15/0014; B30B 15/0064; B30B 15/14; B30B 15/308; B30B 15/32; B01F 5/16
See application file for complete search history.

(56) References Cited

U.S. PATENT DOCUMENTS 2,178,714 A * 11/1939 Anderson ..... B30B 9/125 100/127
3,756,434 A * 9/1973 Teske ..... B65G 53/66 222/413
4,279,556 A * 7/1981 Ronning ..... B65G 53/48 406/53
4,590,977 A * 5/1986 Schmidt ..... B65B 1/12 141/129
5,464,120 A * 11/1995 Alpers ..... A23G 9/228 222/1
5,653,879 A * 8/1997 Schroeder ..... B01D 29/25 210/298
6,199,780 B1 3/2001 Görlitz

FOREIGN PATENT DOCUMENTS

DE 2 330 039 A1 1/1974
DE 42 32 449 A1 3/1994
DE 197 18 455 A1 11/1997
DE 197 23 761 A1 1/1998
DE 298 20 464 U1 1/1999
WO WO-2007057293 A1 * 5/2007 ..... B30B 9/3025

* cited by examiner

COMPRESSOR ARRANGEMENT FOR AUTOMATIC COMPRESSING OF GROUND COFFEE

CROSS REFERENCE TO PRIOR APPLICATIONS

This application is a U.S. National Phase application under 35 U.S.C. § 371 of International Application No. PCT/EP2015/055031, filed on Mar. 11, 2015 and which claims benefit to German Patent Application No. 10 2014 106 407.0, filed on May 7, 2014. The International Application was published in German on Nov. 12, 2015 as WO 2015/169483 A1 under PCT Article 21(2).

FIELD

The present invention relates to a compressor arrangement for the automatic compressing of ground coffee, the compressor arrangement having a first housing which has an inlet opening and an outlet opening, wherein conveying and compressing elements are provided in the housing which are drivable by at least one first drive device, wherein the outlet opening has a retention flap which serves to adjust the bulk density of the ground coffee, wherein an adjustment device is provided via which a pre-adjustment of the bulk density can be adjusted.

BACKGROUND

Compressor arrangements are well known from the prior art. DE 197 18 455 A1, for example, describes a compressor arrangement wherein the ground coffee from a grinder is compressed according to specifications regarding filling weight and filling volume. The ground coffee to be filled must thereby have a defined bulk density (gram per $cm^3$). For this purpose, the compressor arrangement of DE 197 18 455 A1 has a retention flap at an outlet opening of the compressor arrangement which can be adjusted with an opening angle from 0° to 90° depending on the desired bulk density. A measuring means for the bulk density or the degree of compaction is provided in the region of the outlet opening so that a regulation is possible via an adjustment of the retention flap.

The above-described arrangement of the measuring device in the region of the outlet opening is complicated and is therefore costly and susceptible to failure. Sudden variations in the quantity of ground coffee in the compressor which are caused, for example, by ground coffee slipping from side walls of the compressor trough, cannot be further compensated for so that overload damage to the first drive device may result.

SUMMARY

An aspect of the present invention is to provide a compressor arrangement for the automatic compression of ground coffee which avoids the above disadvantages in an economic and simple manner.

In an embodiment, the present invention provides a compressor arrangement for automatically compressing ground coffee which includes a first housing comprising an inlet opening and an outlet opening which comprises a retention flap configured to adjust a bulk density of the ground coffee, a first drive device, conveying and compressing elements arranged in the first housing, the conveying and compressing elements being configured to be driven by the first drive device, and an adjustment device configured to provide a pre-adjustment of the bulk density of the ground coffee. The adjustment device comprises a second drive device, a retention flap shaft, a retention flap arranged on the retention flap shaft, a transmission which is operatively connected to each of the second drive device and the retention flap shaft, and an automatic dynamic pressure adjustment apparatus configured to enlarge or reduce a preset of the opening angle dependent on a higher dynamic pressure or a lower dynamic pressure being exerted on the retention flap. The transmission comprises a transmission device configured to limit an opening angle of the retention flap.

BRIEF DESCRIPTION OF THE DRAWINGS

The present invention is described in greater detail below on the basis of embodiments and of the drawings in which.

DETAILED DESCRIPTION

Figure 1:
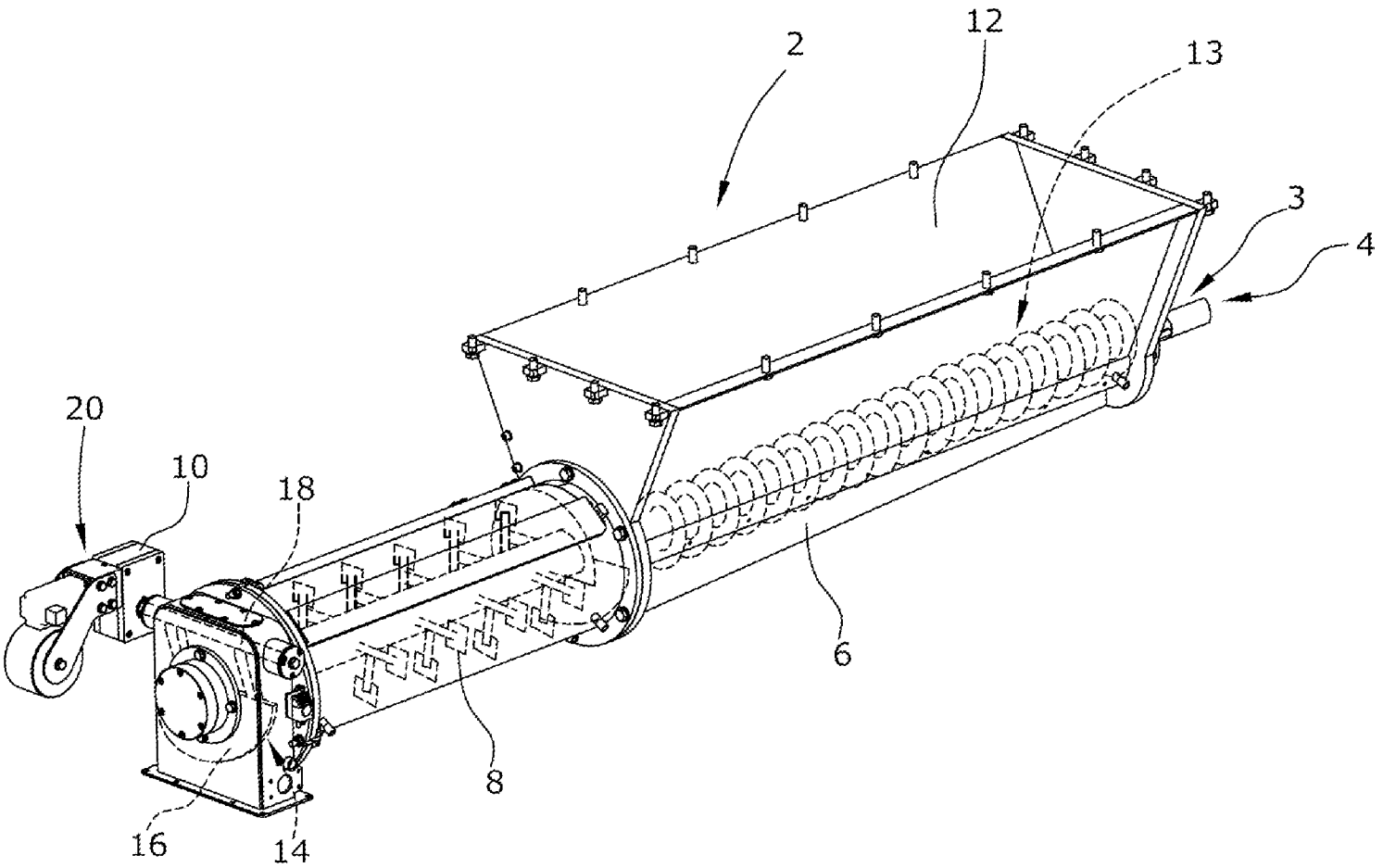
FIG. 1 shows a perspective arrangement of the compressor arrangement of the present invention.

In an embodiment of the present invention, the adjustment device comprises a second drive device operatively connected with a transmission which is operatively connected to a retention flap shaft on which the retention flap is arranged so that the transmission can enable a limiting of the opening angle of the retention flap, and wherein an automatic dynamic pressure adjustment apparatus is provided which, in the case of a higher or lower dynamic pressure being exerted on the retention flap, enables an enlarging or reducing of the preset opening angle. The retention flap is thus no longer preset to a defined angle but may be pivoted up to a certain predefined opening angle. A short-term exceeding or undershooting of the ground coffee quantity, and thus an increase or decrease in the dynamic pressure acting on the retention flap, can be compensated in a simple manner via the mechanical dynamic pressure adjustment apparatus. The retention flap may thereafter be pivoted back to the preset opening angle. A measuring device in the region of the outlet opening is therefore no longer required.

In an embodiment of the present invention, the transmission can, for example, be a worm gear with a worm shaft and a worm wheel, wherein a transmission housing part is provided which is rotatably supported on the retention flap shaft and in which the worm wheel is supported on the retention flap shaft for rotation therewith so that a rotation of the worm shaft allows a rotation of the transmission housing part around the worm wheel, and wherein the transmission housing part has a defined weight assigned thereto that allows the pre-adjustment of the desired opening angle. A pre-adjustment of the maximum opening angle of the retention flap is thereby provided in a particularly simple manner, wherein the mechanical dynamic pressure adjustment apparatus is realized by the transmission and the transmission housing part with the associated weight so that, in case an adjustment of the preset opening angle is required, the retention flap shaft may pivot with the transmission housing part via the transmission. It is possible to obtain the desired bulk density due to the weight adjustment. It should be noted that the term "preset opening angle" is understood as the opening angle the retention flap assumes when a dynamic pressure is applied. The retention flap is thus closed in the deactivated state of the compressor arrangement. It is thereby of course possible, based on knowledge of the machine-specific data of the respective compressor arrangement, such as output, dimensions etc., to store weights as data in combination with a respective opening angle and thus a desired bulk density and to thereby provide a simple adjustment.

In an embodiment of the present invention, a weight element can, for example, be provided that is connected with the transmission housing part via a lever arrangement. A different moment acts on the retention flap shaft via a simple turning of the lever, whereby a different force also acts on the retention flap shaft, whereby the retention flap opens wider or narrower due to the dynamic pressure prevailing. It is thereby conceivable to adjustably arrange the weight element at the lever arrangement so that the compressor arrangement has a greater flexibility and the adjustment range is enlarged.

An inadvertent adjustment, for example, due to a malfunction of the second drive device, is prevented in a simple manner because the worm wheel may have a circular segment-shaped groove element into which a pin element engages which in turn is supported in the transmission housing part so that the rotation of the transmission housing part during the pre-adjustment is limited by a first and a second end of the groove element.

In an embodiment of the present invention, the maximum opening angle of the retention flap can, for example, be limited by a stop element that cooperates with the retention flap shaft.

In an embodiment of the present invention, the second drive device can, for example, be operatively connected with the transmission via a coupling which may, for example, be designed as a releasable coupling.

In an embodiment of the present invention, the second drive device can, for example, be an electric machine, in particular a stepper motor. To allow a simple representation of the preset opening angle, for example, on a display, the adjustment device may comprise a sensor element to monitor the position of the retention flap shaft. This may be performed directly or indirectly, for example, by a phase shift of the transmission.

The present invention will be explained in detail below with reference to the drawings.

FIG. 1 is a perspective view of a compressor arrangement 2 of the present invention for the automatic compression of ground coffee. The compressor arrangement 2 has a housing 4 substantially comprised of a plurality of housing parts 6, 8, 10, which may in turn be of a multi-part design. The first housing part 6 is trough-shaped and has an inlet opening 12 which, in a manner known per se, adjoins a grinder (which is not illustrated in detail herein). A screw conveyor (not illustrated in detail herein) may be arranged in the first housing part 6 to convey the ground coffee on to the second housing part 8 in which a turbo mixer (not illustrated in detail herein) is arranged to homogeneously distribute coffee skins and to compress the ground coffee. The screw conveyor and the turbo mixer are connected in a manner known per se with a first drive device 3. The ground coffee is compressed by the turbo mixer in the direction of an outlet opening 14 provided in the second housing part 8, the outlet opening 14 being adjoined by a retention flap 16. The retention flap 16 is hinged to a retention flap shaft 18 which in turn is operatively connected with an adjustment device 20 which has a transmission housing part as the third housing part 10. The retention flap 16 closes the outlet opening 14 in the non-actuated state of the compressor arrangement 2. As will be explained in more detail hereinafter with reference to FIGS. 2 and 3, the adjustment device 20 allows a pre-adjustment of the opening angle of the retention flap 16, whereby an adjustment of the bulk density of the ground coffee becomes possible.

Figure 2:
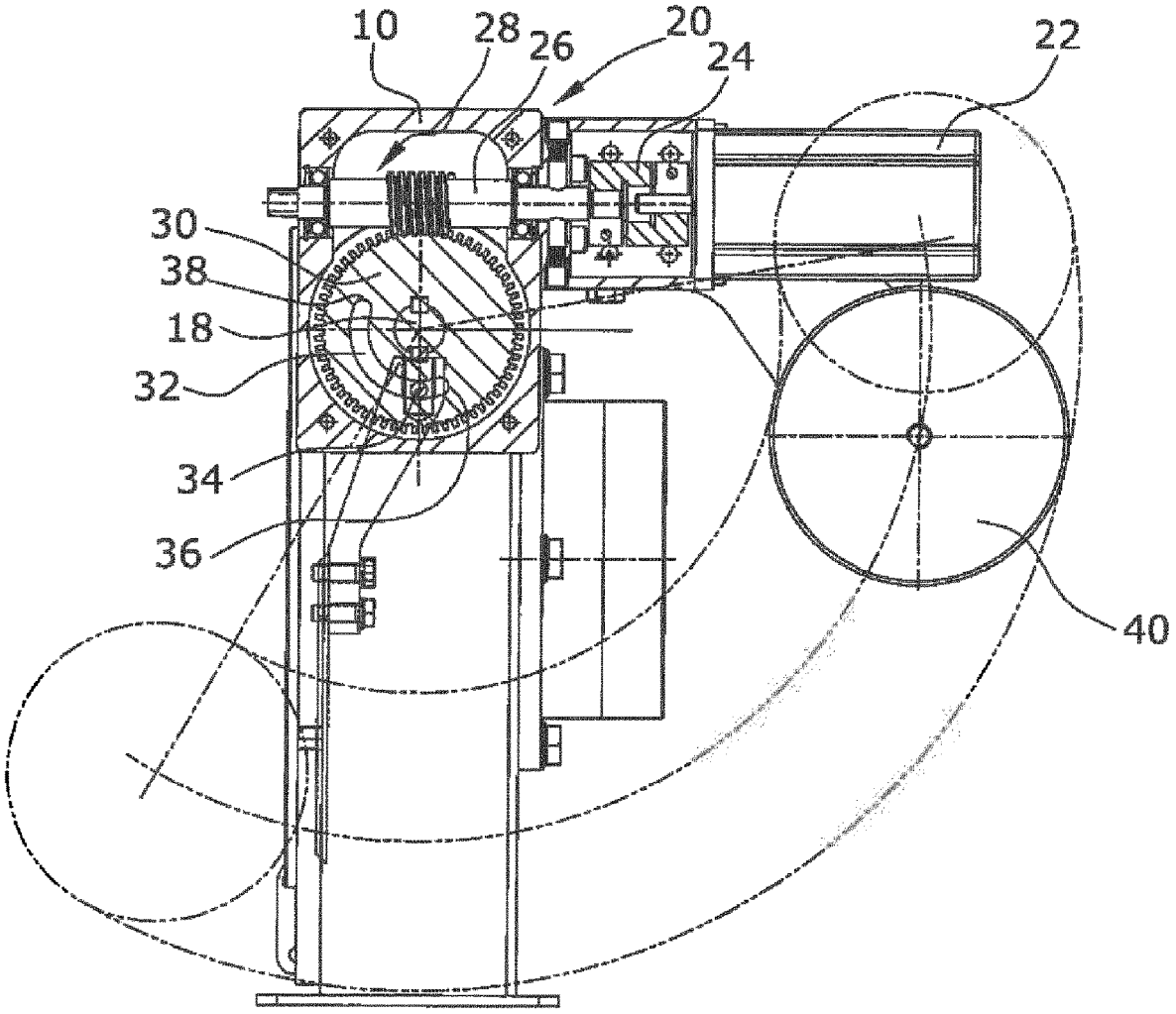
FIG. 2 shows is a partially cut side view of an adjustment device of the compressor arrangement of FIG. 1 in a first adjustment position.

FIG. 2 shows a sectional view of the adjustment device 20. The adjustment device 20 has a second drive device 22 operatively connected with a worm shaft 26 of a worm gear 28 via a coupling 24. In a manner known per se, the worm gear 28 comprises a worm wheel 30 supported on the retention flap shaft 18 for rotation therewith. The worm shaft 26 is rotatably supported in the transmission housing part 10, wherein the transmission housing part 10 is rotatably supported on the retention flap shaft 18. The worm wheel 30 also has a continuous, circular segment-shaped groove element 32 into or through which a pin element 34 engages that is fixedly connected with the transmission housing part 10. The angle of the circular segment of the groove element 32 is chosen to be larger than the adjustment angle of the adjustment device 20 as explained below. In the present case, the angle of the circular segment is about 140°. The groove element 32 with the engaging pin element 34 prevents an inadvertent adjustment of the adjustment device 20 beyond the adjustment angle. The groove element 32 has a first end 36 and a second end 38 for this purpose. The transmission housing part 10 has a weight element 40 assigned thereto which is connected with the transmission housing part 10 via a lever arrangement 42 via which it is adjustable (see reference numeral 43 in FIG. 3). The maximum opening angle of the retention flap 16 is further limited by a stop element (not illustrated in detail herein) which cooperates with the retention flap shaft 18.

The second drive device 22 is actuated for pre-adjustment. At that moment, the retention flap 16 closes the outlet opening 14 and cannot deflect in this direction so that the retention flap shaft 18, and thus the worm wheel 30, do not move. The worm shaft 26 and thus the transmission housing part 10 consequently move in a clockwise direction about the worm shaft 26, whereby the weight element 40 is adjusted on the circular path indicated. The weight force acting in the vertical downward direction is thereby associated with a variable lever which causes a variable moment to act on the retention flap shaft 18, and thus causes a variable force to act on the retention flap 16. In FIG. 2, the preset position is chosen so that a great lever acts on the weight element 40 and thus a great force acts on the retention flap 16. A bulk density can thereby be achieved that is at about 90% of the maximum compression.

When the first drive device 3 of the compressor arrangement 2 is activated and the ground coffee is conveyed in a compressed state via conveying and compressing elements 13 towards the outlet opening 14, a dynamic pressure is built in the region of the outlet opening 14 which eventually causes the retention flap 16 to open, whereby the retention flap shaft 18 turns the worm wheel 30 and thereby the entire adjustment device 20, formed by the transmission/worm gear 28, the transmission housing part 10, the weight element 40, and the second drive device 22, is turned counterclockwise. In case of short-term variations of the ground coffee quantity, the dynamic pressure on the retention flap 16 will increase or decrease, which is compensated by an automatic shifting of the weight element 40. The entire adjustment device 20 forms the mechanical automatic dynamic pressure adjustment arrangement in the present embodiment.

The adjustment device 20 will subsequently pivot back into the preset position due to the weight force of the weight element 40.

Figure 3:
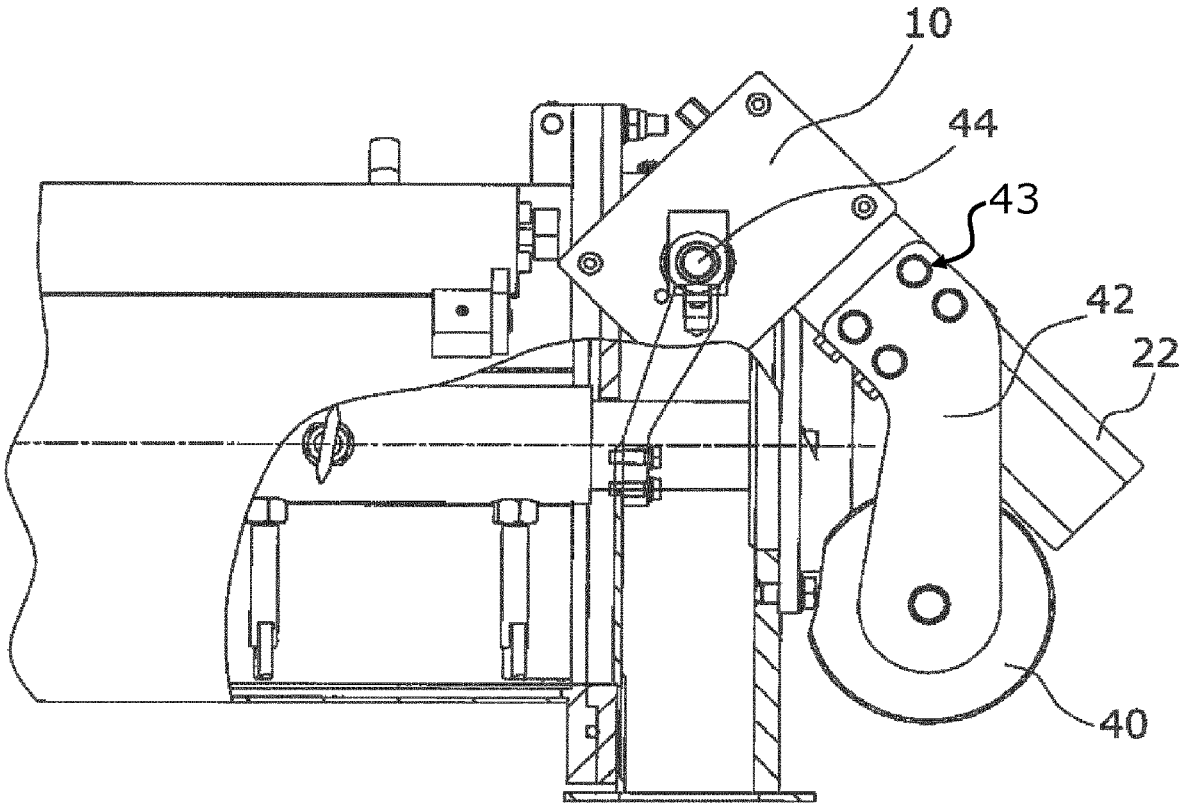
FIG. 3 shows the adjustment device of the compressor arrangement of FIG. 1 in a second adjustment position.

FIG. 3 illustrates the adjustment device 20 in a side view, wherein the adjustment device 20 is pivoted by an angle of about 45% and thus causes a compression of about 45% of the maximum compression. The lever element 42, via which the weight element 40 is hinged to the transmission housing part 10, is also clearly visible. Reference numeral 44 denotes a sensor element, for example, a Hall sensor, which detects the pivot angle of the retention flap shaft 18 and thus monitors the opening angle of the retention flap 16. The second drive device 22 is designed as a stepper motor in the shown embodiment.

It should be clear that a variety of possible embodiments are conceivable, in particular with regard to the design of the transmission, all of which fall within the scope of protection of the present invention. Reference should also be had to the appended claims.

What is claimed is:

1. A compressor arrangement for automatically compressing ground coffee, the compressor arrangement comprising:

a first housing comprising an inlet opening and an outlet opening, the outlet opening comprising a retention flap configured to adjust a bulk density of the ground coffee;

a first drive device;

conveying and compressing elements arranged in the first housing, the conveying and compressing elements being configured to be driven by the first drive device; and an adjustment device configured to provide a pre-adjustment of the bulk density of the ground coffee, the adjustment device comprising:

a second drive device;

a retention flap shaft having the retention flap arranged thereon;

a transmission which is operatively connected to each of the second drive device and the retention flap shaft, the transmission being configured to limit an opening angle of the retention flap;

an automatic dynamic pressure adjustment apparatus configured to enlarge or reduce a preset of the opening angle dependent on a higher dynamic pressure or a lower dynamic pressure being exerted on the retention flap; and a transmission housing part configured to be rotatably supported on the retention flap shaft, wherein, the transmission is a worm gear comprising, a worm shaft, and a worm wheel, the worm wheel is arranged in the transmission housing part and is supported on the retention flap shaft to rotate with the retention flap shaft so that a rotation of the worm shaft provides a rotation of the transmission housing part around the worm wheel, and a defined weight is assigned to the transmission housing part, the defined weight providing for the preset of the opening angle.

2. The compressor arrangement as recited in claim 1, wherein the automatic dynamic pressure adjustment apparatus comprises a lever arrangement and the defined weight which is connected with the transmission housing part via the lever arrangement.

3. The compressor arrangement as recited in claim 2, wherein the defined weight is configured to be adjustable at the lever arrangement.

4. The compressor arrangement as recited in claim 1, wherein, the transmission further comprises a pin element, the worm wheel further comprises a groove element which comprises a first end, a second end, and a circular segment into which the pin element engages, and the pin element is supported in the transmission housing part so that a rotation of the transmission housing part during the pre-adjustment is limited by the first end and the second end of the groove element.

5. The compressor arrangement as recited in claim 1, further comprising:

a coupling, wherein, the second drive device is operatively connected with the transmission via the coupling.

6. The compressor arrangement as recited in claim 5, wherein the coupling is a releasable coupling.

7. The compressor arrangement as recited in claim 1, wherein the second drive device is an electric machine.

8. The compressor arrangement as recite in claim 1, wherein the second drive device is a stepper motor.

9. The compressor arrangement as recited in claim 1, wherein the adjustment device further comprises a sensor element configured to monitor a position of the retention flap shaft.

* * * * *